US005743031A

United States Patent [19]

Launder et al.

[11] Patent Number: 5,743,031

[45] Date of Patent: Apr. 28, 1998

[54] DIGGING HARDWARE SIGNALING APPARATUS

[75] Inventors: Brian L. Launder, Tulsa; William A. Flagg, Owasso, both of Okla.

[73] Assignee: H&L Company, Tulsa, Okla.

[21] Appl. No.: 606,065

[22] Filed: Feb. 23, 1996

[51] Int. Cl.[6] ..... E02F 9/28; G08B 5/40; E21C 35/08

[52] U.S. Cl. ..... 37/455; 37/456; 37/413; 37/906; 116/214; 299/1.2

[58] Field of Search ..... 37/454, 455, 456, 37/460, 413, 358, 446, 449, 465, 906; 116/214, 81, 70, 208; 299/1.2, 1.05

[56] References Cited

U.S. PATENT DOCUMENTS

| | | | |
|---|---|---|---|
| 1,052,392 | 2/1913 | Van Dyken . | |
| 1,755,642 | 4/1930 | Gannon . | |
| 1,859,350 | 5/1932 | Wilson | 37/454 X |
| 2,360,315 | 10/1944 | Campbell et al. . | |
| 3,092,827 | 6/1963 | Pearce | 116/214 X |
| 3,108,789 | 10/1963 | Heimaster et al. | 299/1.2 |
| 3,581,703 | 6/1971 | Hosack . | |
| 3,678,885 | 7/1972 | Ferguson | 116/DIG. 13 |
| 3,718,113 | 2/1973 | Schertler et al. . | |
| 4,181,360 | 1/1980 | Wilson | 299/1.2 |
| 4,368,919 | 1/1983 | Whittaker et al. | 299/1.2 |
| 4,407,081 | 10/1983 | Hanson | 37/141 T |
| 4,604,604 | 8/1986 | Mann | 340/52 A |
| 4,655,082 | 4/1987 | Peterson | 299/1.2 X |
| 5,010,962 | 4/1991 | Bloom, Jr. | 37/906 X |
| 5,063,396 | 11/1991 | Smith | 37/141 T |
| 5,144,762 | 9/1992 | Robinson | 37/141 T |

FOREIGN PATENT DOCUMENTS

| | | |
|---|---|---|
| 380-801 | 5/1973 | U.S.S.R. . |
| 578-405 | 10/1977 | U.S.S.R. . |
| 585-258 | 12/1977 | U.S.S.R. . |
| 781-281 | 11/1980 | U.S.S.R. . |

*Primary Examiner*—Terry Lee Melius
*Assistant Examiner*—Thomas A. Beach
*Attorney, Agent, or Firm*—John W. Harbst

[57] ABSTRACT

An apparatus for providing a signal indicative of loss or imminent loss of digging hardware normally arranged in operable association with an earth working implement.

50 Claims, 9 Drawing Sheets

FIG. 1
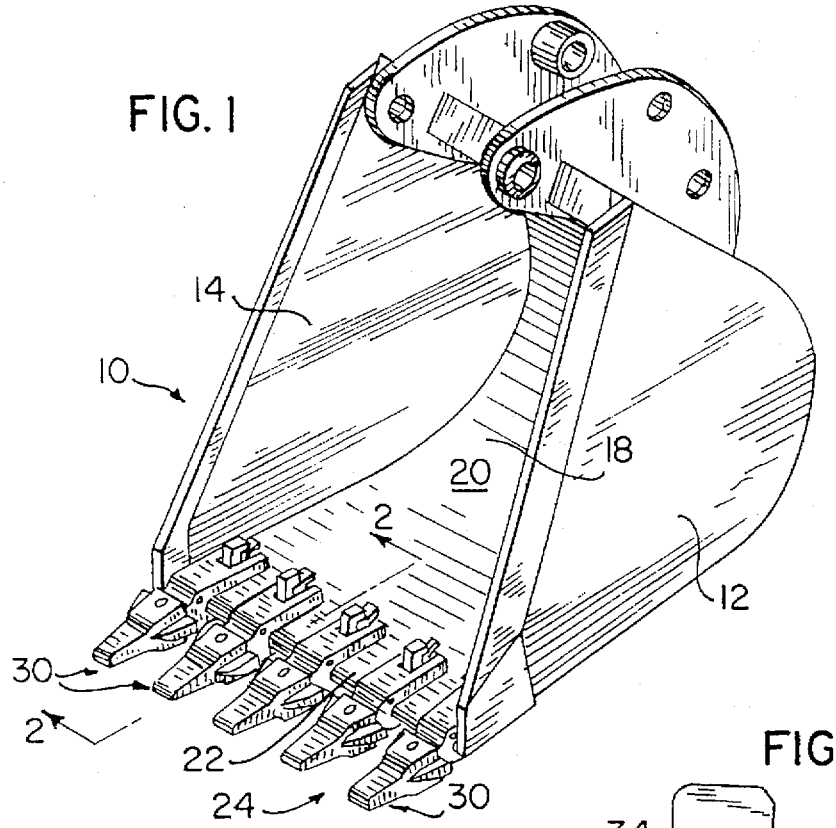
FIG. 2
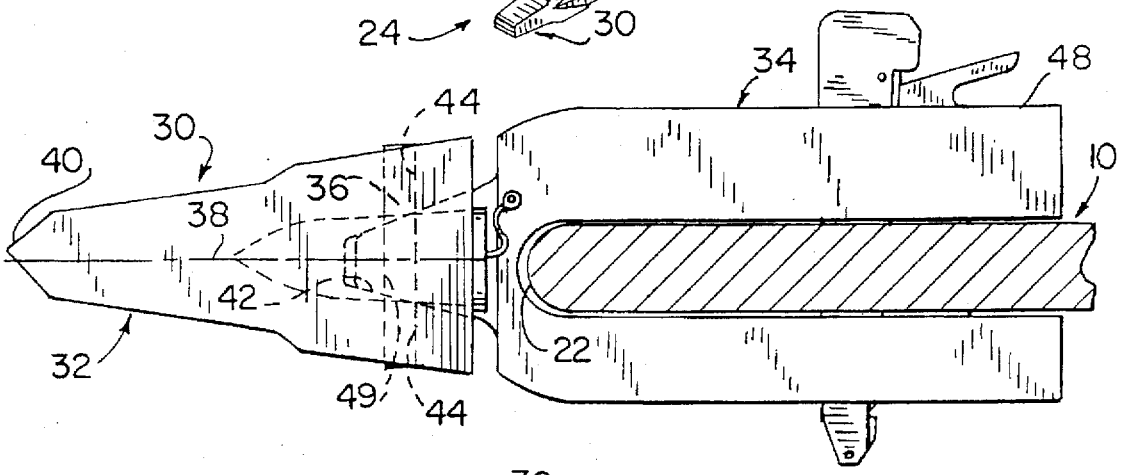
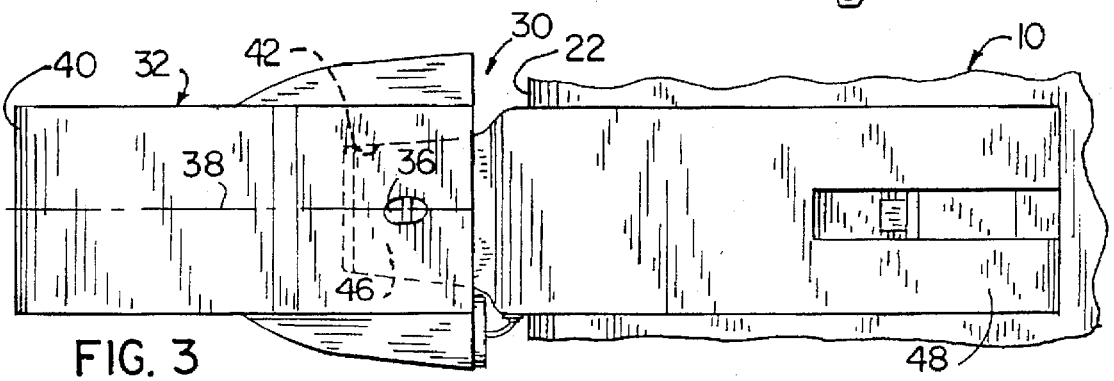
FIG. 3

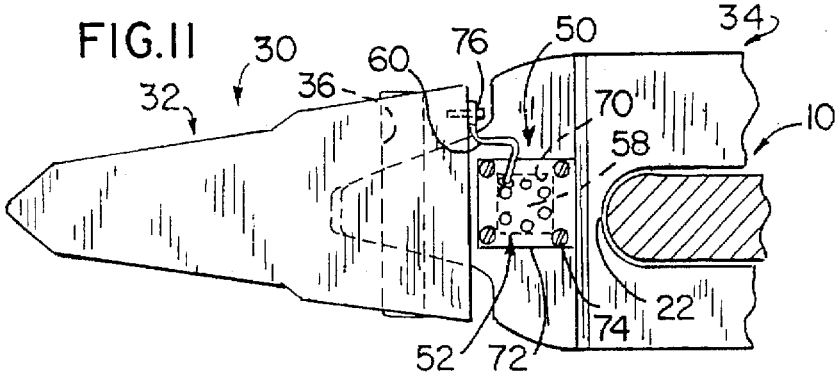
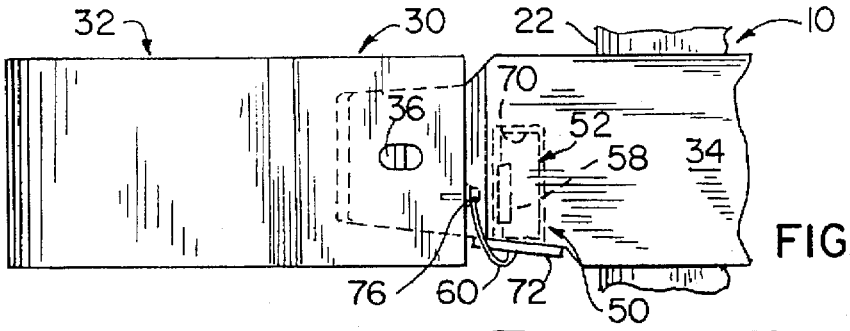
FIG. 12
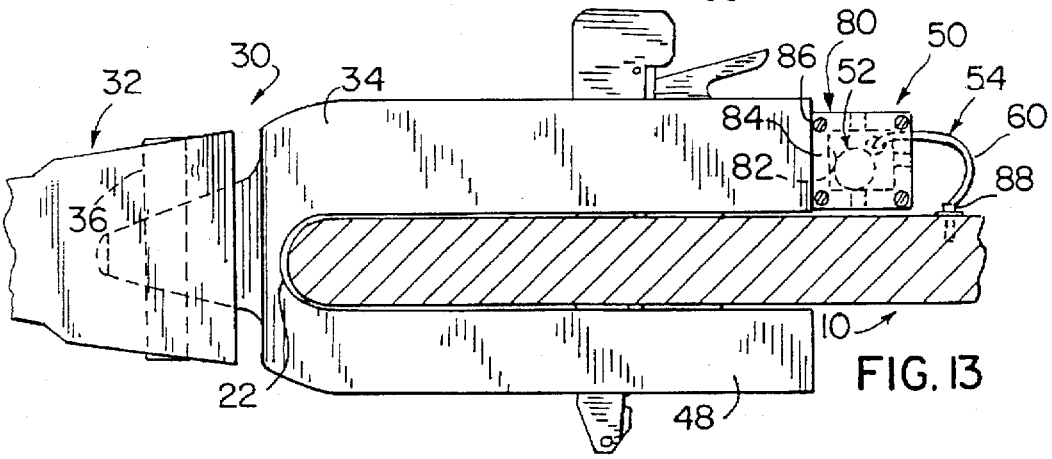
FIG. 13
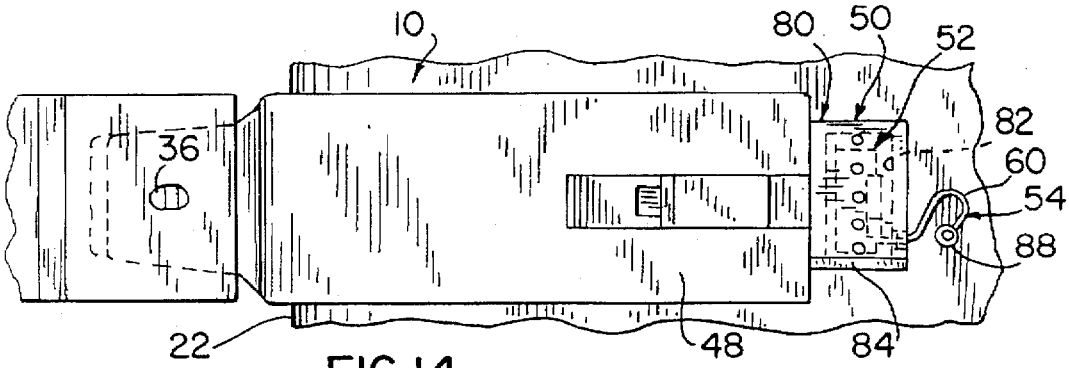
FIG.14

FIG. 15
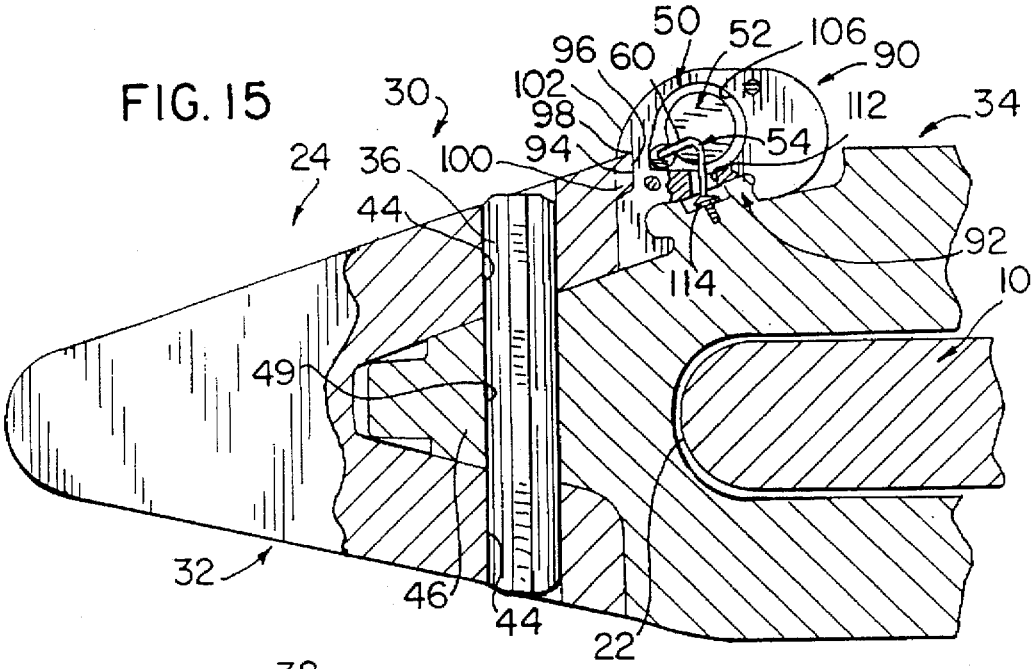
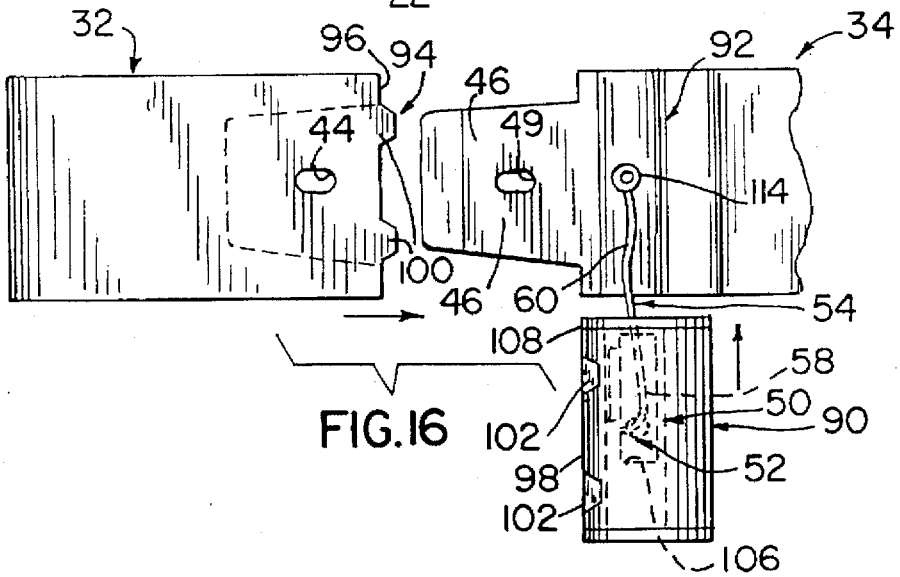
FIG. 16
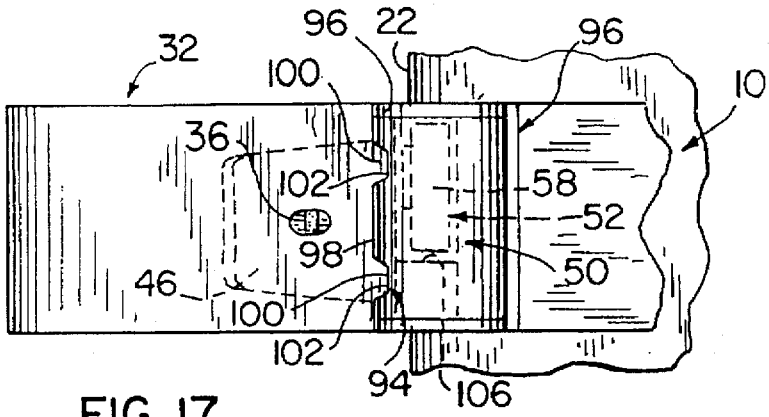
FIG. 17

DIGGING HARDWARE SIGNALING APPARATUS

FIELD OF THE INVENTION

The present invention generally relates to earth working implements and, more specifically, to an apparatus for providing a signal indicative of imminent or actual loss of digging hardware normally arranged in operable association with an earth working implement.

BACKGROUND OF THE INVENTION

Earth working implements including excavators are typically provided with a bucket or scoop that include a pair of sidewalls and a bottomwall which interconnects the sidewalls and provides a forwardly disposed lip or digging edge on the bucket or scoop. It is common to attach digging hardware to the leading edge or lip of the bucket or scoop of such digging or excavating implement.

The digging hardware used in combination with the excavating or digging implement can take many forms. For example, such digging hardware can include a series of lip shrouds that surround and project forwardly from the forwardly disposed lip or edge of the digging implement. Such lip shrouds are typically connected in releasable relation to the bucket or scoop by a connector to promote changing of the lip shroud when they are worn. Alternatively, the digging hardware can include a series of digging tooth assemblies.

A conventional digging tooth assembly typically includes an adapter and a digging tooth or point. The adapter has a base portion which is connected in predetermined relation to the forward lip of the bucket and a nose portion projecting forwardly from the lip or the bucket. The tooth or point is removably secured in predetermined relation to the nose region of the adapter. In some instances, a wear member or cap is arranged in operable combination and predetermined relation toward a rear end portion of the digging tooth. Preferably, the wear cap or member is slidably mounted on the adapter and is mounted in its predetermined relation relative to and by the tooth.

The connector used to releasably interconnect the digging hardware to the bucket conventionally includes an elongated generally wedge shaped pin or member that is subjected to extreme load conditions during operation of the excavating bucket. In one form, one elongated surface of the wedge shaped pin or member has a series of serrations or other suitable surface configurations that combine with a detent to releasably maintain the digging hardware in predetermined relation relative to the digging or excavating implement. When the digging hardware requires replacement, an operator manually removes the pin to allow other digging hardware to replace that which is worn or otherwise requires replacement.

As will be appreciated by those skilled in the art, such digging and excavating equipment is typically utilized in extremely harsh and abrasive environments. Accordingly, the digging hardware and the connector pin releasably holding the digging hardware to the excavating or digging implement tend to quickly wear and/or break under the extreme load conditions. Of course, should the connector pin become dislodged, displaced, or break, its ability to hold the digging hardware in an operable predetermined relationship relative to the digging implement is lost. In the example where the connector pin releasably maintains the adapter in operable combination and/or predetermined relationship with the implement, failure of the connector pin resulting from displacement or breakage, unless timely realized by the operator, will ultimately result in loss of the digging tooth assembly. In those instances where a wear cap or member is arranged in combination and in predetermined relationship with the digging moth, loss, breakage or displacement of the connector pin will likely result in additional loss of the wear member.

As will be appreciated, digging, excavating and/or mining environments are relatively dense with smoke, dust, dirt and noise. Thus, an operator of such digging equipment can not always reasonably appreciate or timely realize when one or more pieces of digging hardware may become inadvertently separated from the bucket or digging implement. Inadvertent loss of the digging hardware, however, can result in significant damage to either the bucket or hardware components that remain attached to the bucket and, thus, are subject to the harsh digging environments unless the loss of such digging hardware is quickly realized by the operator of the digging or excavating equipment. For example, continued operation of the digging implement following loss of one or more of the digging hardware components can quickly result in significant damage to the remainder of the digging hardware components such as the nose region of the respective adapter or the leading edge of the bucket or scoop of the digging implement. As will be appreciated, damage to the remainder of the digging hardware components and/or bucket/scoop edge only exacerbates the downtime required to repair and/or replace the loss and damage to the digging hardware and digging implement.

To prolong the usefulness thereof, digging hardware releasably attached to the digging implement is typically cast or forged from extremely hard steel alloys and some are quite massive in size and weight. The inadvertent loss of digging hardware such as a digging tooth, adapter, wear member, or lip shroud, into the excavated materials can cause severe operational problems with material processing equipment involved with downstream operations. After the inadvertently lost digging hardware commingles with the excavated or shovelled materials, such hardware is not readily recognizable. In the excavation of rock, for example, the hard metal digging hardware inadvertently lost from the excavating bucket or implement readily mixes with the excavated material and can severely damage the downstream crushing apparatus/processing equipment.

Thus, there is a long unfulfilled need and a desire to provide an apparatus for signaling loss or impending loss of digging hardware normally arranged in operable association with an earth working implement.

SUMMARY OF THE INVENTION

In view of the above, and in accordance with the present invention, there is provided an apparatus for indicating loss or impending loss of digging hardware relative to a digging implement. The apparatus of the present invention provides a signal to the operator of the implement indicative of the loss or impending loss of an operable association between the digging hardware and the digging or excavating implement. The signal provided by the indicating apparatus can be visual, audio, or a form of radio signal sufficient to alert the operator to the loss or impending loss of the digging hardware.

According to one aspect of the present invention, the digging hardware includes a high strength component that is adapted for connection to and in predetermined relationship with a leading edge of a digging or excavating implement such as a bucket or scoop. A warning apparatus is provided for indicating an inadvertent change in the predetermined relationship between the digging hardware and the digging implement. Accordingly, the warning apparatus provides an adequate warning that the digging hardware component is about to be or has become separated from the digging implement. Thus, the operator can quickly cease further operations to repair and/or search for the displaced digging component.

In accordance with another important aspect of the present invention, the digging hardware is configured as a digging or excavating tooth assembly. The tooth or point assembly comprises a high strength digging tooth that is secured in predetermined relationship with a forward edge of a bucket or scoop of the digging implement. Advantageously, a warning apparatus is provided for indicating an inadvertent change in the predetermined relationship between the digging tooth and the digging implement.

As mentioned above, an adapter is typically provided in combination with the digging tooth. The adapter has a base portion that arranges the tooth assembly in predetermined relation relative to the digging or excavating implement and a nose portion. The digging tooth is arranged in releasable association with the nose region of the adapter. The warning apparatus monitors the predetermined relationship between the adapter and the bucket or scoop of the excavator implement and provides a suitable signal to alert the operator in response to an inadvertent change in the predetermined relationship between the adapter that maintains the digging tooth assembly in place and the bucket or scoop from which the tooth assembly forwardly projects.

The digging tooth assembly can further include a wear member extending across a rear portion of the digging tooth. The digging tooth and wear cap or member define cooperative instrumentalities therebetween for maintaining the digging tooth and wear member in predetermined relationship relative to each other. In accordance with the present invention, an apparatus is provided for signaling an inadvertent change in the predetermined relationship between the wear member and the digging tooth.

As will be readily appreciated, the signaling apparatus of the present invention can take a myriad of different forms. As mentioned above, and with respect to those embodiments discussed above, the signaling or warning apparatus preferably comprises an actuatable indicator and an actuator. The actuator monitors the predetermined relationship between the high strength component of the digging hardware and its predetermined relation relative to a leading edge of the digging or excavating implement. Upon sensing an inadvertent change in the predetermined relationship of the digging hardware, the actuator actuates the indicator to provide a signal or indication of a condition that requires immediate operator attention.

In a most preferred form of the invention, the actuatable indicator includes a smoke canister protectively carried by either the high strength component of the digging hardware or the digging implement. The smoke canister can releasably be mounted within a closable cavity defined by a lip shroud, digging tooth, adapter, wear cap or other suitable digging hardware. The actuator is connected between the canister and alternative digging components or the digging implement such that upon loss of the predetermined relationship therebetween, the canister is actuated to release a visible signal such as smoke to alert the operator to a condition that requires timely attention.

Still another aspect of the present invention relates to a connector pin assembly for releasably connecting digging hardware to the digging implement so as to promote replacement/ repair of the digging hardware. The connector pin assembly includes an elongated connector pin for maintaining the digging hardware in a predetermined relationship relative to a front or forward edge of the digging implement. The connector pin assembly further includes a warning apparatus operably associated with the connector for providing a signal in the event of a failure of the connector to maintain the digging hardware in operable combination or in predetermined relationship with the front or leading edge of the digging implement.

Preferably, the connector pin is comprised of first and second elongated connector pieces arranged in operable relationship relative to each other. The connector pin further includes shear pins for inhibiting the connector pieces from inadvertent endwise movement relative to each other. Outer surfaces of the connector pieces combine with each other, when arranged in their predetermined operable relationship relative to one another, to define a wedge shaped outer surface configuration for the connector. Moreover, an outer surface of one of the connector pieces has a serrated configuration disposed between opposite ends of the connector piece such that it can combine with a suitable detent mechanism to releasably hold the connector pin in place during normal operation of the implement. When the digging hardware requires repair/ replacement, the operator manually displaces one connector piece relative to the other as by shearing of the pins therebetween thus facilitating removal of the connector pin assembly without causing the warning apparatus to provide a signal indicative of the failure of the connector pin to maintain the digging hardware in a predetermined relationship relative to the digging implement.

The warning apparatus arranged in operable association with the connector pin preferably comprises an actuatable indicator carried by a first elongated connector piece of the connector and an actuator operably coupled to said actuator. The actuator monitors the operable relationship between the connector pieces and actuates the actuatable indicator to provide a signal indicative of an inadvertent change in the operable relationship of the connector pieces relative to each other. As will be appreciated, an inadvertent change in the operable relation is an indication of the failure of the connector pin assembly's ability to maintain the digging hardware connected to the implement or bucket and, thus, the imminent loss of the digging hardware relative to the implement or bucket. Preferably, the actuatable indicator comprises a smoke canister protectively carried by the first connector piece and with the actuator connected to the second connector piece. Notably, the connector pin assembly is configured such that one connector piece can be purposefully displaced relative to the other connector piece without actuating the warning apparatus of the present invention.

With the present invention, virtually all digging hardware including whistler style adapters, bolt on and weld on adapters, one-piece digging or excavating teeth, replaceable digging or excavating teeth, and shrouds can be monitored and an indication of loss or imminent loss of such digging hardware being provided to the operator in a manner allowing the operator to quickly cease operation to permit recovery and repair and/or replacement of the digging hardware. In one form of the invention, a signal indicative of imminent loss of the digging hardware results upon failure of the connecting pin and, more specifically, when an actuatable indicator is actuated in response to the inability of the connector pin to hold the digging hardware in operable association with the digging implement. Notably, the type of signal provided by the indicator is not necessarily limited to smoke. Any signaling device that can be activated such as strobe lights, whistles, radio devices, GPS receiver units and etcetera are meant to be included within the spirit and scope of the present invention. Another advantage of the present invention is the ability to retrofit existing equipment with the present invention. Moreover, in those situations wherein the present invention is utilized to indicate imminent loss of the digging hardware, it will be possible for the operator to bring the excavating equipment to a halt before the digging hardware has separated from the digging implement thus facilitating repair/replacement of such digging hardware and/or connector pin for maintaining the digging hardware in operable association with the digging implement.

The present invention, together with further objects, aims and advantages thereof, will be best understood by reference to the following detailed description taken in conjunction with the appended claims and the accompanying drawings.

BRIEF DESCRIPTION OF THE DRAWINGS

FIG. 1 is a perspective view of a digging or excavating implement with one form of digging hardware attached to a front or leading edge of the implement;

FIG. 2 is an enlarged fragmentary side elevational view taken along line 2—2 of FIG. 1;

FIG. 3 is a top plan view of that form of digging hardware illustrated in FIG. 2;

FIG. 11 is a side elevational view similar to FIG. 5 but showing an alternative arrangement for the signaling apparatus of the present invention;

FIG. 12 is a top plan view of FIG. 11;

FIG. 13 is an enlarged side elevational view showing another alternative arrangement of the signaling apparatus of the present invention;

FIG. 14 is a top plan view of FIG. 13;

FIG. 15 is an enlarged side elevational view similar to FIG. 5 but showing another alternative arrangement of the present invention arranged in operable combination digging hardware;

FIG. 16 is a disassembled top elevational view of the digging hardware components illustrated in FIG. 15;

FIG. 17 is an assembled top elevational view of the digging hardware components illustrated in FIG. 15;

DETAILED DESCRIPTION OF THE INVENTION

Figure 4:
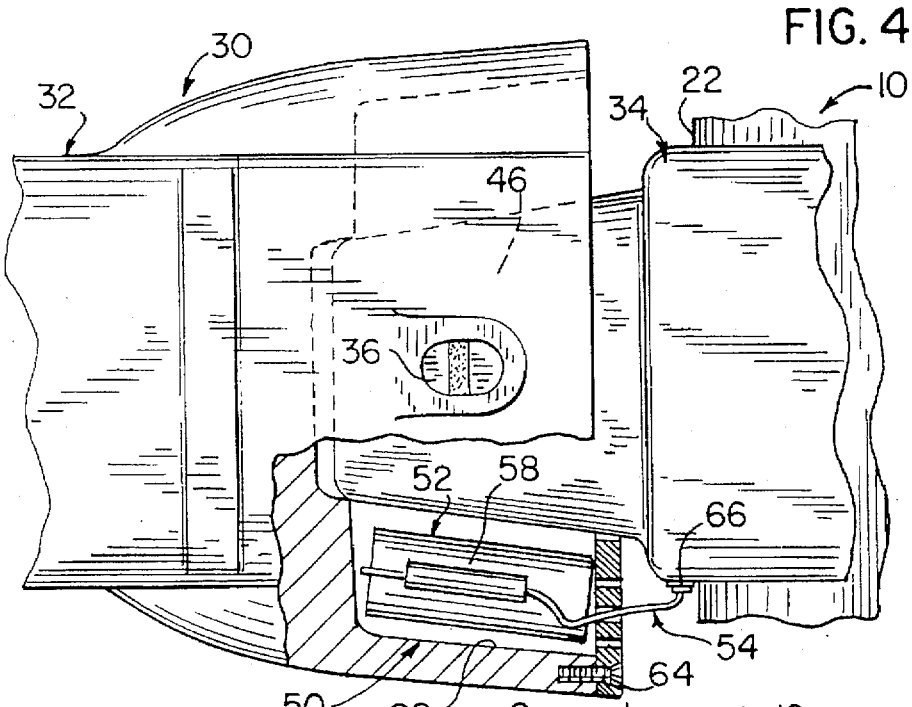
FIG. 4 is an enlarged top plan view of that form of digging hardware illustrated in FIGS. 2 and 3.

While the present invention is susceptible of embodiment in various forms, there are shown in the drawings and will hereinafter be described preferred embodiments of the invention with the understanding that the present disclosures are to be considered as setting forth exemplifications of the invention which are not intended to limit the invention to the specific embodiments illustrated.

Referring now to the drawings, wherein like reference numerals refer to like pans throughout the several views, there is shown in FIG. 1 a conventional digging or excavating bucket or scoop 10 forming part of an earth working or digging implement. As is typical, the bucket or scoop 10 has two vertically disposed, transversely spaced apart sidewalls 12 and 14 which are rigidly held in place by a backwall 18 to form a generally scoop shaped enclosure 20. The backwall 16 and the two sidewalls 12 and 14 are preferably securely joined together by a process such as welding. The bucket or scoop 10 has a forward edge or lip 22 on which is mounted digging hardware 24. The bucket or scoop 10 is adapted to be attached to an excavating machine (not shown) such as a backhoe, a mining power shovel or other conventional excavating equipment.

The digging hardware 24 is attached in predetermined relationship or operative relation to the scoop or bucket 10 and can take a myriad of different shapes and sizes. For example, the digging hardware 24 can comprise a series of well known high strength metal lip shrouds that are arranged in predetermined relationship about the forward edge or lip 22 of the bucket or scoop 10. An exemplary embodiment of digging hardware 24 is shown in FIG. 1 as including a series of digging tooth assemblies 30 arranged in transversely spaced, forwardly extending relation relative to the forward edge or lip 22 of the bucket or excavating implement 10.

As well known in the art, and as shown in FIGS. 2 and 3, each digging or excavating tooth assembly 30 preferably includes a high strength metal digging or excavating tooth 32 preferably mounted to a metal adapter or support member 34 such that the digging tooth 32 extends forwardly from the lip or edge 24 of the excavating implement 10. To promote repair/replacement, each digging tooth 32 is removably connected to the adapter 34 by a connector pin 36.

As shown, each digging tooth 32 is preferably formed from cast alloy steels and has an elongated configuration defining an elongated axis 38 with a ground penetrating or cutting edge 40 extending transversely across a forward end portion thereof. Moreover, each digging tooth 32 has a blind socket 42 that opens to a rear portion of the tooth 32. In the area of the socket 42, each digging tooth 32 further includes a pair of axially aligned holes or openings 44 (FIG. 2) that permit the connector pin 36 to pass endwise therethrough.

Each adapter 34 is typically configured with a nose region 46 at a distal end thereof. As is well known, the nose region 46 is configured to complement and cooperate with the configuration of the blind socket 42 on the tooth 32 such that the digging tooth 32 is adapted to fit about and extend, at least partially lengthwise along the nose region 46 of the adapter 34, in a predetermined and operative relation relative to the lip or edge 22 of the bucket or excavating implement 10. A rear or base region 48 of each adapter 34 is suitably configured to permit the adapter 34 to be secured in a predetermined and operative relationship relative to the lip or edge 22 of the bucket 10 as by welding, a suitable clamp, by a connector pin, or other suitable means of connection. As shown, the adapter 34 further defines, toward a forward end thereof, a throughbore or opening 49 (FIG. 2) for allowing the connector pin 36 to pass endwise therethrough in a manner releasably coupling the digging tooth 32 to the adapter 34.

If a digging tooth 32 inadvertently breaks off, or in the event that the connector pin 36 fails to maintain the digging tooth 36 in operative association with the adapter 34, such digging hardware can quickly become lost in the material being excavated and conveyed with the material to processing equipment arranged downstream of the digging or excavating site. Alternatively, the adapter 34 may become dislodged from its operative association with the bucket or implement 10 and one or more entire tooth assemblies 30 may be lost or commingled with the material being excavated. Due to the hardness and strength of such digging hardware, it may cause significant problems to the crushing or processing equipment.

Figure 5:
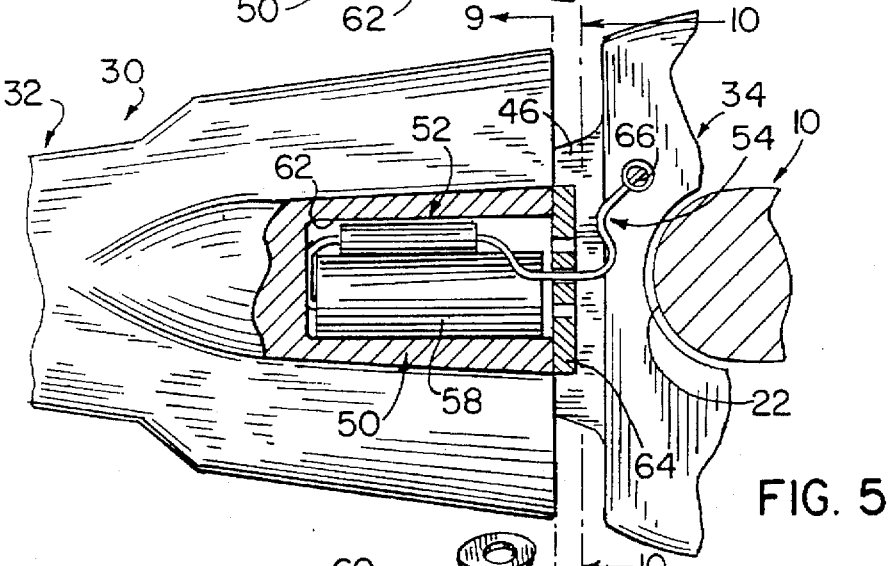
FIG. 5 is a side elevational view of that form of digging hardware illustrated in FIG. 4.

That described above is well known in the art. As shown in FIGS. 4 and 5, the present invention is related to an apparatus 50 for providing an indication of the loss or imminent loss of digging hardware normally arranged in predetermined operable association with the forward or leading edge 22 of a digging or excavating implement 10. The signal provided by the indicating apparatus 50 of the present invention provides a timely warning to the operator to temporarily cease the excavating or digging operation to permit recovery/repairs/replacement of any digging hardware that has become inadvertently separated from the implement 10.

Figure 6:
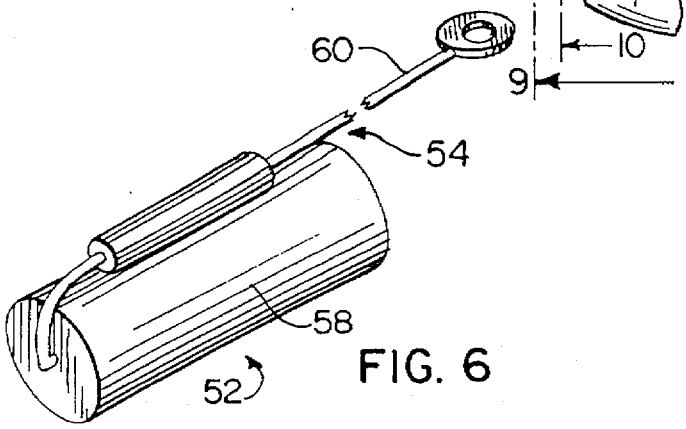
FIG. 6 is a perspective view of one form of actuatable indicator forming part of the signaling apparatus of the present invention.
Figure 7:
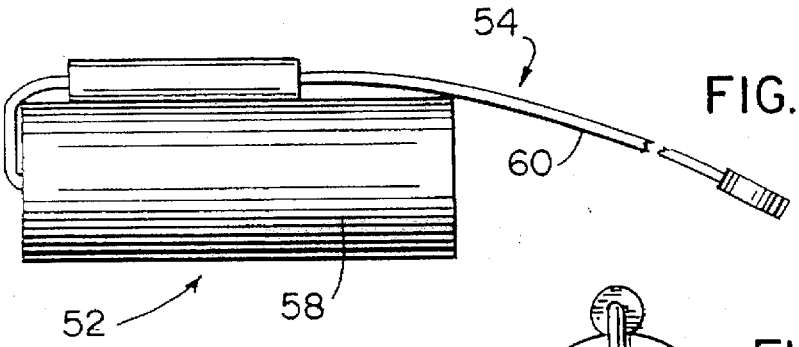
FIG. 7 is a from elevational view of that form of actuatable indicator illustrated in FIG. 6.
Figure 8:
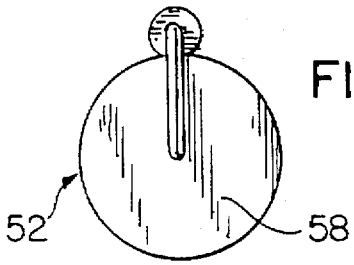
FIG. 8 is an end view of the actuatable indicator.

The warning apparatus 50 comprises an actuatable indicator 52 and an actuator 54 arranged in operable combination relative to each other. In one form of the invention, and as shown in FIGS. 4 through 8, the actuatable indicator 52 comprises a signal generator such as a smoke canister 58 that is capable of producing a visual signal of smoke when activated. A smoke canister of the type marketed and sold by Visible Techniques, Inc. of Old Bridge, N.J. 08857 is one example of a type of smoke canister that would suffice to provide a signal of smoke. As shown in FIGS. 6 and 7, the smoke canister 58 has a lanyard 60 extending from and which serves as the actuator 54 for the canister 58. The purpose of lanyard 60 is to monitor the predetermined relationship between the digging hardware 24 and the implement 10. Upon an inadvertent change in the redetermined relationship between the digging hardware 24 and the implement 10, the actuator 54 actuates the indicator 52 to develop a signal to indicate such change. In the illustrated embodiment, inadvertent displacement of the digging hardware 24 relative to the implement 10 is sensed by the lanyard 60. As will be appreciated, movement of the lanyard 60 relative to the smoke canister 58 will result in a readily identifiable and visual signal of smoke being released by the smoke canister 58.

Figure 9:
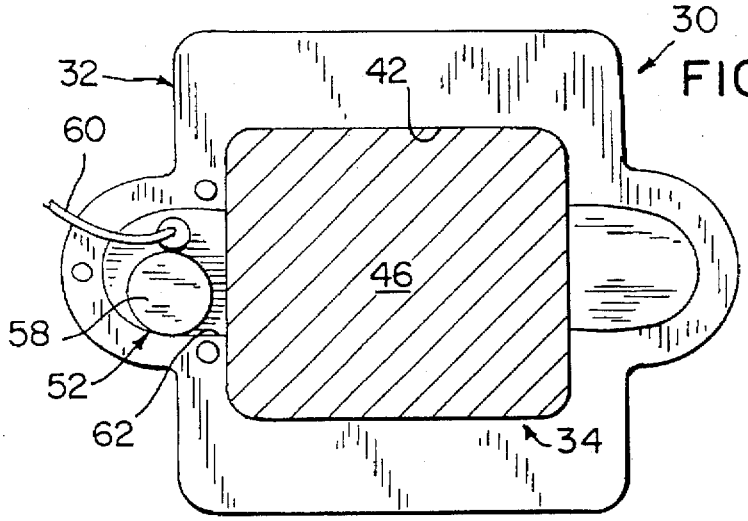
FIG. 9 is a sectional view taken along line 9—9 of FIG. 5.
Figure 10:
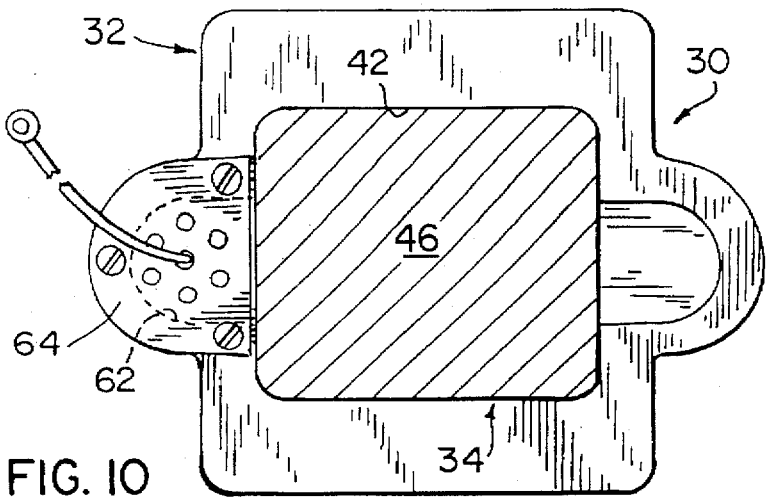
FIG. 10 is a sectional view taken along line 10—10 of FIG. 5.

In the embodiment of the invention illustrated in FIGS. 4, 5, 9 and 10, the smoke canister 58 is releasably mounted within a cavity 62 defined adjacent and that opens to the blind socket 42 defined in each digging tooth 32 of the digging tooth assembly 30. As shown in FIGS. 4, 5 and 9, the rear end of cavity 60 can either be closed by a web or wall extending thereacross or a replaceable and preferably apertured plate 64 can extend thereacross so as to prevent the canister 58 from inadvertently separating from the digging tooth 32. Notably, the lanyard 60 for the smoke canister 58 extends outwardly and beyond the cavity 60.

After the smoke canister 58 is positioned within the cavity 62, the nose region 46 of a respective adapter 34 is conventionally positioned within the blind socket 42 and the connector pin 36 (FIG. 4) is inserted to maintain the adapter 34 and the digging tooth 32 in operable association relative to each other. As should be appreciated, with the nose region 46 of the adapter inserted within the socket 42 and the apertured plate 64 secured to the adapter 34 or the wall of the adapter 34 passing across the rear side of cavity 62, the signal generator or smoke canister 58 for the warning apparatus 50 is secured in place. Thereafter, a free end of the lanyard 60 is secured to the adapter 34. As shown in FIGS. 4 and 5, the free end of the lanyard 60 is suitably configured to facilitate attachment thereof as through use of a headed fastener 66 or the like. Understandably, the free end of the lanyard 60 should be secured as close as possible to the adapter 34, and to the fullest extent possible the lanyard 60 should be protected, to inhibit inadvertent actuation by the excavated materials during the excavating or digging operations. Alternatively, the free end of the lanyard 60 could be secured to the forward edge 22 of the implement 10 if desired so long as the lanyard 60 is protected against inadvertent actuation by excavated materials or the digging/excavating operations.

Thus, should the digging tooth 32 break off or become inadvertently dislodged from the adapter 34, the lanyard 60 will sense this change in the predetermined relationship between the adapter 34 and the digging tooth 32 and actuate the indicator 52. In the instance mentioned above, actuation of the indicator 52 will result in a visual signal of smoke being released by the smoke canister 58 to quickly alert the operator to a loss of digging hardware from the implement 10.

FIGS. 11 and 12 indicate an alternative arrangement for the warning apparatus 50. In this embodiment, the adapter 34 is provided with an open ended blind cavity 70. The cavity 70 is configured to releasably accommodate the signal generator 52 which, in the illustrated embodiment, includes the smoke canister 58. As will be appreciated, this form of the invention simplifies the design of the digging moth 32. That is, in this alternative design of the warning apparatus 50, the design of the digging moth 32 is simplified by eliminating the cavities 62 on opposite sides of the blind socket 42. Accordingly, the digging moth 32 could be formed from cast or forged alloy steels.

As shown in FIGS. 11 and 12, and after the signal generator or smoke canister 58 is located in the cavity 70 defined by the adapter 34, an apertured plate 72 is placed across the open end of the cavity 70 so as to maintain the actuatable indicator 52 in place. Plate 72 may be secured across the open end of cavity 70 by suitable fasteners 74 (FIG. 11). Thereafter, the free end of the lanyard 60, operably associated with and serving as the actuator 54 for the indicator 52, is passed through an aperture in plate 72 and is secured to the respective digging tooth 32. A suitable and preferably headed fastener 76 can be used to secure the free end of the lanyard 60 in a protected location to either the digging tooth 32 or to the implement 10. As understood, the purpose of the lanyard 60 is to monitor the predetermined relationship between the adapter 34 and the digging tooth 32.

Thus, should the digging tooth 32 break off or become inadvertently dislodged from the adapter 34, the lanyard 60 will sense this change in the predetermined relationship between the adapter 34 and the digging tooth 32 and actuate the indicator 52. In the instance mentioned above, actuation of the indicator 52 will result in a visual signal of smoke being released by the smoke canister 58 to quickly alert the operator to a loss of digging hardware from the implement 10.

FIGS. 13 and 14 indicate an alternative arrangement for the warning apparatus 50. In this embodiment, an apertured housing 80 is suitably secured to the base portion 48 of the adapter 34. The apertured housing 80 is provided with an open ended blind cavity 82. The cavity 82 is configured to releasably accommodate the actuatable indicator 52 of the warning apparatus 50 which, in the illustrated embodiment, includes the smoke canister 58. After the actuatable indicator 52 is located in the cavity 82 an apertured plate 84 is placed across the open end of the cavity 82 so as to maintain the actuatable indicator 52 in place. Plate 84 may be secured across the open end of cavity 82 by suitable fasteners 86 (FIG. 13). Thereafter, the free end of the lanyard 60, operably associated with and serves as the actuator 54 for the indicator 52, is passed through an aperture in plate 84 and is secured to a convenient and protected location on the digging or excavating implement 10. A suitable and preferably headed fastener 88 can be used to secure the free end of lanyard 60 to the implement 10. As understood, the purpose of the lanyard 60 is to monitor the predetermined relationship between the adapter 34 and the digging Or excavating implement 10. Thus, should the adapter 34 break off or become inadvertently dislodged from the digging implement 10, the lanyard 60 will sense this change in the predetermined relationship between the adapter 34 and the excavating implement 10 and will actuate the actuatable indicator 52. In the instance mentioned above, actuation of the indicator 52 will result in a visual signal of smoke being released by the smoke canister 58 to quickly alert the operator to a loss of digging hardware from the implement 10. As will be appreciated, apertures in housing 80 will promote the dispersement of smoke to quickly alert the operator to loss of digging hardware that requires attention.

Still another alternative embodiment of digging hardware is illustrated in FIGS. 15, 16 and 17. In this embodiment, the digging hardware 24 operably associated with the digging or excavating implement 10 includes the conventional digging tooth 32 and adapter 34 combination as discussed above. In addition, however, the digging hardware 24 operably associated with the digging or excavating implement 10 can further include a wear member or cap 90 arranged in a predetermined operable association with both the digging tooth 32 and the adapter 34.

As is well known in the art, the wear cap or member 90 is arranged rearwardly of the digging tooth 32 and across a top surface of the nose region 46 of the adapter 34. The purpose of the wear member 90 is to protect that region of the adapter 34 disposed rearwardly of the digging tooth 32 against the abrasive materials being excavated by the implement 10.

As shown in FIGS. 15 and 16, and as known in the art, the wear member 90 and adapter 34 combine to define a dovetail type-slidable connection 92 therebetween. Although the wear member or cap 90 has a tendency to wear at a significantly quicker rate than the adapter 34, the wear cap or member 90 is nevertheless typically formed from alloy cast steel material and can cause significant damage to crushing and other processing equipment if such wear member 90 becomes inadvertently commingled with the excavated material removed during the digging or excavating process.

In the illustrated embodiment, and as represented in FIGS. 16 and 17, the wear cap 90 is slidably positioned and maintained in a predetermined relationship with the digging tooth 32 by cooperative instrumentalities 94 defined between the rear surface 96 of the digging tooth 32 and an abutting surface 98 of the wear member 90. As shown, the digging tooth 32 is provided with two or more transversely spaced projections 100 extending axially from the rear face 96 of tooth 32 in predetermined relation relative to each other. Moreover, the front or abutting face 98 of the wear member 90 has suitably shaped depressions 102 that are configured to releasably accommodate the projections 100 on the rear surface 92 of the digging tooth 32 thereby preventing sliding movement of the wear member relative to the digging tooth 32 after the projections on each digging tooth 32 are accommodated within the recesses 102 defined on surface 98 of a respective wear member 90. It should be appreciated, however, that other means for securing the wear member 90 in predetermined relation to the adapter and/or digging tooth 32 would equally suffice without detracting or departing from the spirit and scope of the present invention.

As is conventional, during assembly of the digging hardware shown in FIGS. 15, 16 and 17, the wear cap or member 90 is slidably positioned across and into a predetermined relationship with the adapter 34. Notably, the sliding connection 92 between the adapter 34 and wear member 90 prevents the wear member 90 from being axially displaced in a fore or aft direction relative to the adapter 34 during an excavating or digging operation. Thereafter, the digging tooth 32 is slidably and axially positioned over the nose region 46 of the respective adapter 34. As the digging tooth 32 slides axially rearwardly along the nose region 46 of the adapter 34, the projections 100 on the rear portion or surface 96 of the digging tooth 32 are accommodated within the depressions or recesses 102 of the wear member 90. Thereafter, the connecting pin 36 is inserted through the openings 44 in the digging tooth 32 and through bore 49 of the adapter 34 to releasably attach the digging tooth 32 to the adapter 34. Once the digging tooth 32 is releasably attached to the adapter 34, the cooperative instrumentalities 94 on the digging tooth 32 and wear member 90 combine with each other to maintain the digging tooth 32 and wear cap 90 in predetermined relationship relative to each other.

An alternative arrangement of the signaling apparatus 50 of the present invention is also illustrated in FIGS. 15, 16 and 17. As shown, the wear member 90 is provided with an open-ended blind bore 106 for releasably accommodating the actuatable indicator 52 of the warning apparatus 50. In the illustrated embodiment, the actuatable indicator 52 of the warning apparatus 50 includes the smoke canister 58. After the signal generator or smoke canister 58 is located in the blind bore 106 of wear member 90, an apertured plate 108 is placed across the open-end of the bore 106 so as to maintain the indicator 52 in place. Plate 108 may be secured across the open-end of bore 106 by suitable fasteners (not shown). Notably, and as shown in FIG. 15, the wear member 90 further defines a bore or opening 112 extending outwardly from the bore 106 and opening to a lower surface of wear member 90. The free end of the lanyard 60, operably associated with and serving as the actuator 54 for the signal indicator 52, passes outwardly through the opening 112 and is secured to the respective adapter 34 preferably in a location beneath the wear member 90 or other suitable protected location. A suitable and preferably headed fastener 114 can be used to secure the free end of lanyard 60 to the adapter 34.

As will be appreciated, the purpose of the lanyard 60 is to monitor the predetermined relationship between the wear member 90 and the adapter 34. Thus, should the digging tooth 32 break off or become inadvertently dislodged from the adapter 34, the wear member 90 is thereafter free to slidably move transversely across the adapter 34. Of course, lateral movement of the wear member 90 relative to the adapter 34 will be sensed by the lanyard 60 and this change in the predetermined relationship between the adapter 34 and the wear member 90 will cause the lanyard 60 to actuate the indicator 52. In the instance mentioned above, actuation of the signal indicator 52 will result in a visual signal of smoke being released by the smoke canister 58 to quickly alert the operator to the loss of digging hardware from the implement 10.

Figure 18:
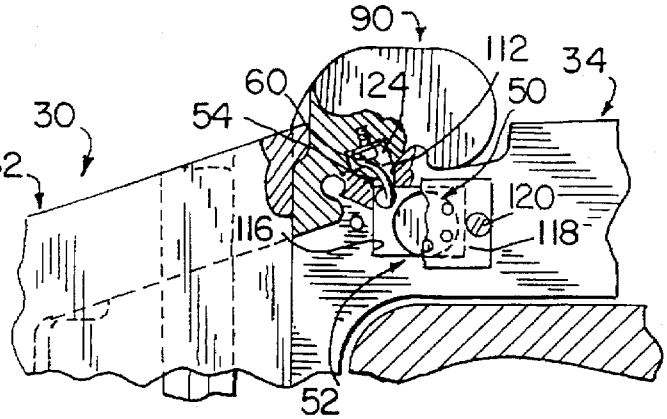
FIG. 18 is an enlarged side elevational view similar to FIG. 15 but showing an alternative arrangement of the present invention in combination with digging hardware.
Figure 19:
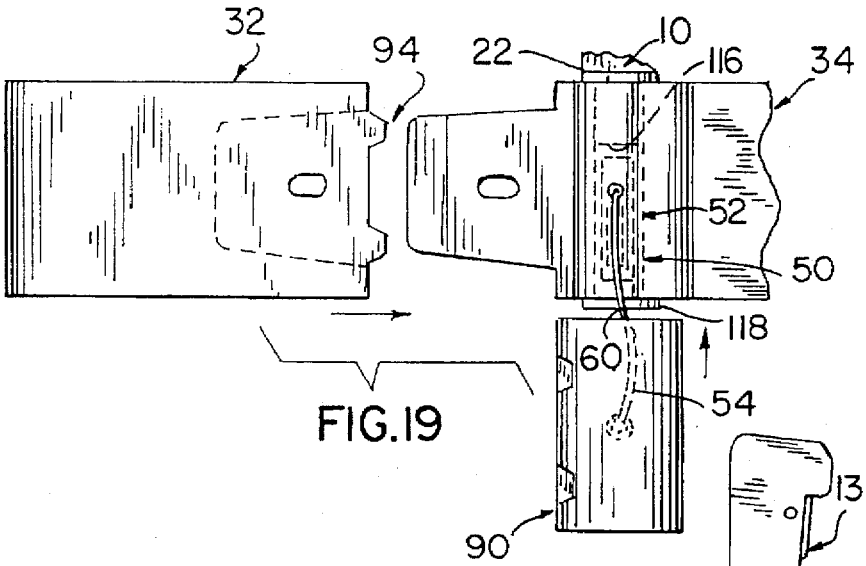
FIG. 19 is a top plan view of the embodiment of the invention illustrated in FIG. 18.

FIGS. 18 and 19 illustrate an alternative arrangement for the warning apparatus 50. In the arrangement illustrated in FIGS. 18 and 19, an open-ended blind bore 116 is defined in the adapter 34. The blind bore 116 is configured to releasably accommodate the indicator 52 of the warning apparatus 50 which, in the illustrated embodiment, includes the smoke canister 58. After the indicator 52 is located in the bore 116, an apertured plate 118 is placed across the open-end of the bore 116 so as to maintain the indicator in place. Plate 118 may be secured across the open-end of bore 116 by suitable fasteners 120. In this embodiment of the invention, an opening or bore 112 leads from the bore 116 and opens to an upper surface of the adapter 34. The free end of the lanyard 60, operably associated with and serving as the actuator 54 for the indicator 52, is passed through the bore 116 and is preferably secured to an underside or undersurface of the wear member 90 or other suitably protected location. A suitable and preferably headed fastener 124 is used to secure the free end of the actuator to the wear member 90.

The purpose of the lanyard 60 is to monitor the predetermined relationship between the adapter 34 and the wear member 90. Thus, should the digging tooth 32 break off or become inadvertently dislodged from the digging implement 10, the predetermined relationship of the digging tooth 32 relative to the adapter 34 and the wear member 90 is also lost and the cooperative instrumentalities 96 defined between the digging tooth 32 and the wear member 90 are no longer effective to maintain the wear member in place relative to the adapter 34. Accordingly, the wear member 90 is substantially free to move relative to the adapter and ultimately become dislodged from the adapter 34. The lanyard 60 will sense this change in the predetermined relationship between the adapter 34 and the wear member 90 and will actuate the indicator 52 of the warning apparatus 50. As will be appreciated, actuation of the indicator 52, in this instance, will result in a visual of smoke being released by the smoke canister 58 to quickly alert the operator to a loss of digging hardware from the implement 10. As will be appreciated, apertures in plate 118 will promote the disbursement of smoke to quickly alert the operator to a loss of digging hardware that requires attention.

Figure 20:
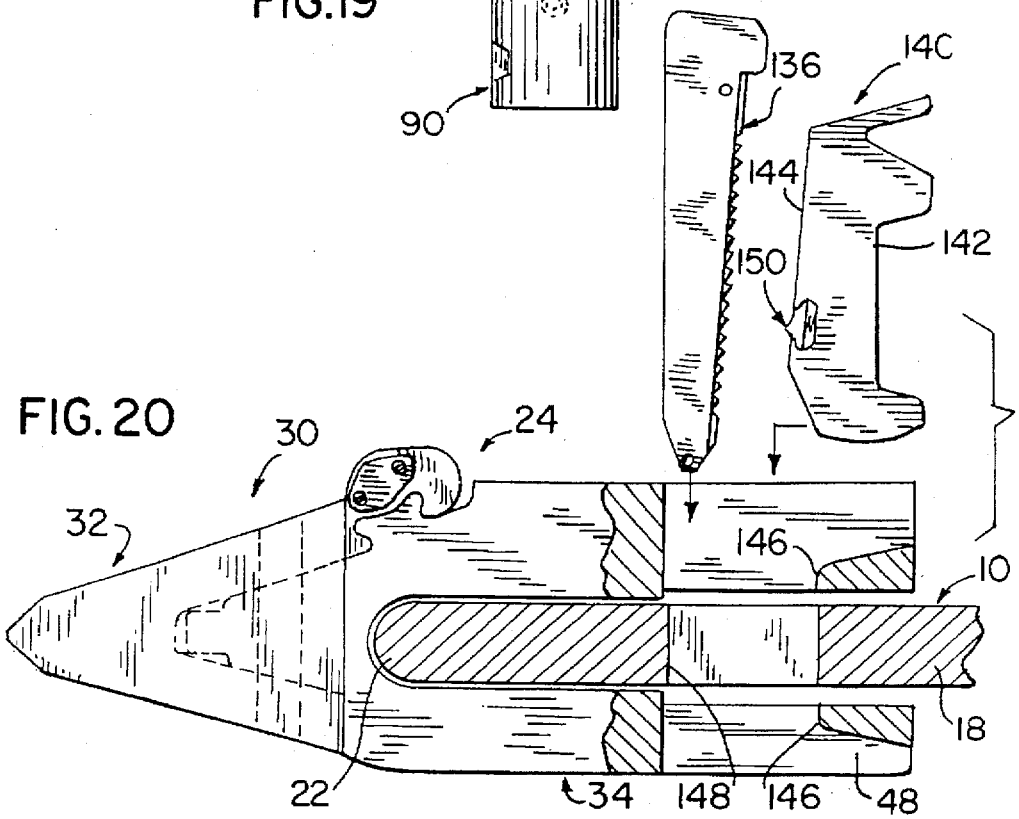
FIG. 20 is a side elevational view, partly in section, showing a connector pin assembly that embodies features of the present invention.

A connector pin assembly 136 embodying salient features of the present invention is shown in FIG. 20. In the exemplary arrangement shown, and as is well known in the art of digging hardware, the base portion 48 of adapter 34 is removably connected to the lip 22 of the excavating bucket or scoop 10 by a generally C-shaped clamp member 140 having rear and front surfaces 142 and 144, respectively. As is typical, the clamp member 140 extends through corresponding slots 146 formed in the base portion 48 of the adapter 34 and through a slot 148 formed in wall 18 of the digging bucket or scoop 10. The connector pin assembly 136, embodying salient features of the present invention, is also secured in the aforementioned slots 146 and 148 in forcible engagement with the front surface 144 of clamp 140 to retain the adapter 34 or similar support member, and thereby the digging tooth assembly 30, connected on the lip 22 of the bucket or scoop 10.

Figure 21:
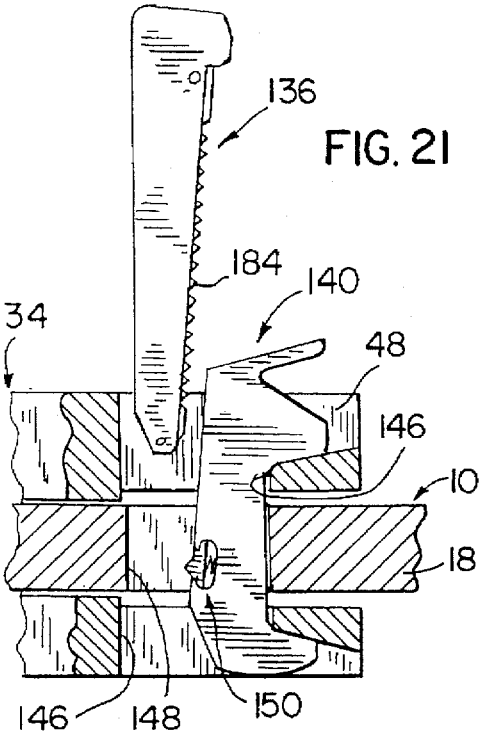
FIG. 21 is a side elevational view similar to FIG. 20.
Figure 22:
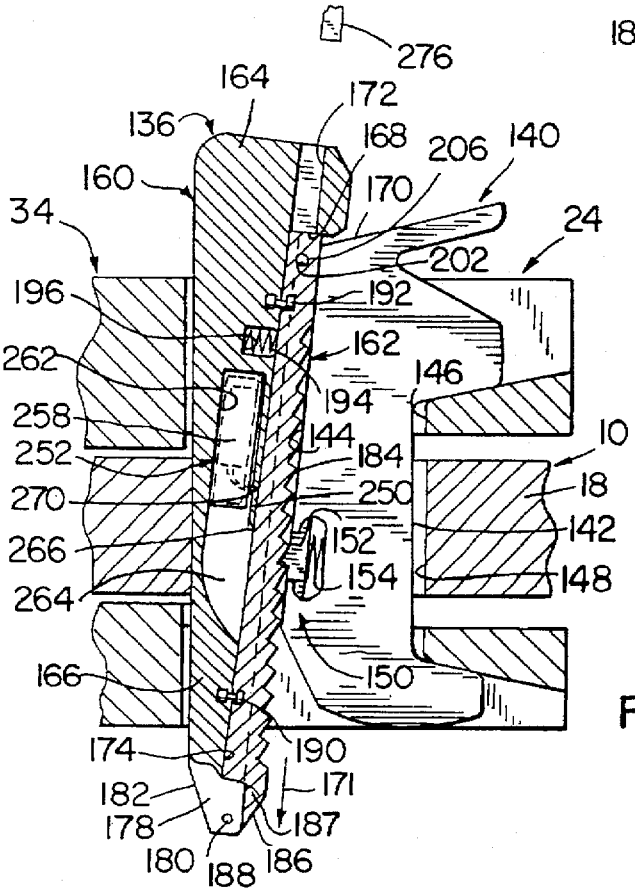
FIG. 22 is a longitudinal sectional view of the connector pin assembly embodying features of the present invention.

In the illustrated embodiment, and as shown in FIGS. 21 and 22, a conventional mechanism 150 is provided along the length of and extends forwardly from the front surface 144 of clamp 140. Mechanism 150 includes a detent 152 that is resiliently urged outwardly away from the surface 144 to engage the outer surface of the connector pin assembly 136. Preferably, a spring 154 is used to resiliently urge the detent 152 outwardly from the front surface 144 of the clamp member 140 and into engagement with the connector pin assembly 136.

Figure 23:
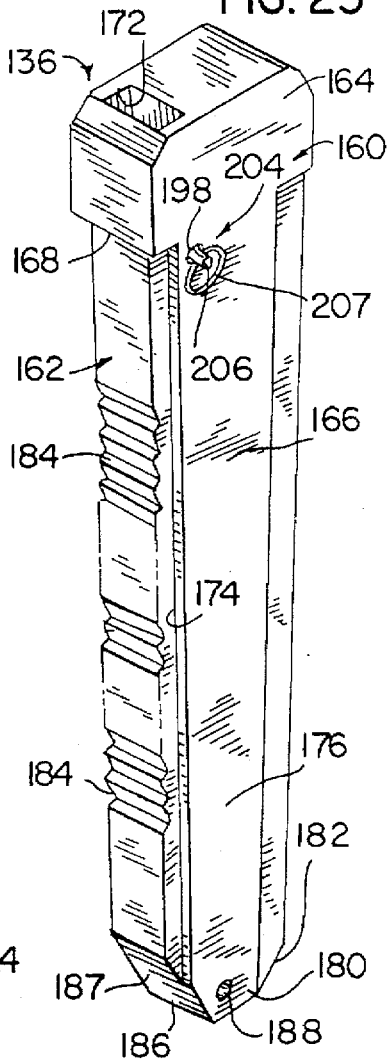
FIG. 23 is a perspective view of an assembled connector pin forming part of the present invention.
Figure 24:
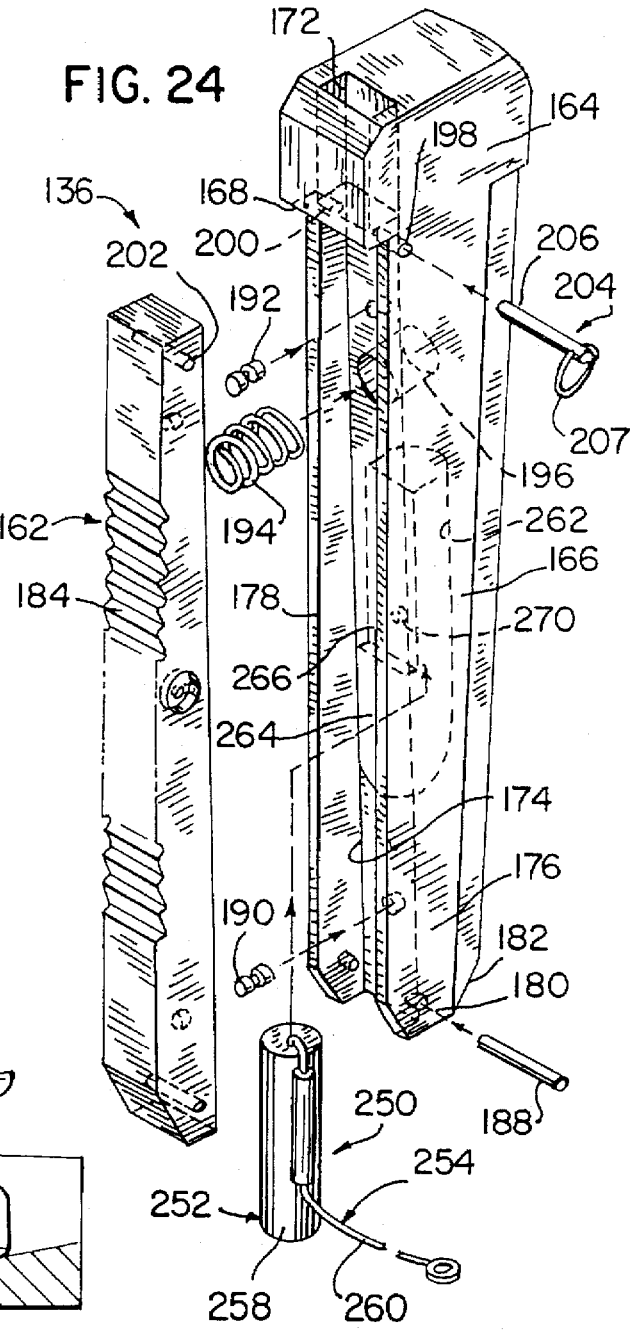
FIG. 24 is a exploded perspective view of the connector pin.

According to the present invention, the connector pin assembly 136 has an elongated vertical wedge-like configuration between opposite ends thereof to allow the pin assembly 136 to pass endwise between the front face 144 of the clamp member 140 and the slots 146, 148 of the adapter 34 and wall 18 of the bucket 10, respectively, thereby releasably maintaining the digging hardware 24 in operable association and in predetermined relation with the lip 22 of the bucket or scoop 10 (FIG. 20). As will be appreciated, the holding force of the wedge shaped pin assembly 136 is a function of the extent the pin assembly 136 is endwise inserted into the slots 146, 148 of the adapter 34 and bucket 10, respectively. As shown in FIGS. 23 and 24, the connector pin assembly 136 comprises first and second connector pieces 160 and 162, respectively, that are each formed of metal and are normally maintained in an operable relationship relative to each other.

As shown in FIGS. 22 and 23, connector piece 160 has an inverted L-shaped configuration including a head portion 164 extending away from an elongated leg portion 166. In the illustrated example, the underside or undersurface 168 of the head portion 164 abuts with a top surface 170 of the clamp member 140 (FIG. 22) to limit endwise movement of the connector pin assembly 136 in the direction of arrow 171. For purposes discussed hereinbelow, the head portion 164 includes a vertical slot 172 that extends through the head portion 164.

In the exemplary form of the invention illustrated in FIG. 24, and for a majority of its length, the connector piece 160 has a generally U-shaped cross-sectional configuration. That is, the connector piece 160 is provided with an elongated vertical channel 174 that is defined between opposed arms 176 and 178. The vertical channel 174 is sized to accommodate connector piece 162 therewithin. Notably, slot 172 opens to the channel 174. Moreover, the lower or distal end portion 180 of connector piece 160 opposite from the head portion 164 preferably has a chamfer-like configuration 182 thereon to facilitate endwise insertion on the connector pin assembly 136 into and through the slots 146, 148 on the adapter 34 and wall 18, respectively, of the bucket or implement 10.

As shown in FIG. 24, the connector piece 162 has an elongated configuration and is sized to fit between the opposed arms 176, 178 and within channel 174 defined by the connector piece 160. Between opposite ends thereof, an outer surface of connector piece 164 has a series of vertically spaced serrations 184. The serrations 184 on the outer surface of the connector piece 162 are adapted to cooperate with the holding mechanism 150 on the clamp member 140 (FIG. 22) to operably maintain the connector pin assembly 136 in place so that the adapter 34 is maintained in operable association with and in a predetermined relation relative to the front edge or lip 22 of the implement 10. Moreover, a lower or distal end portion 186 of connector piece 162 opposite from the head portion 164 of connector piece 160 preferably has a chamfer-like configuration 187 thereon in opposed relation relative to the chamfer 182 on connector piece 160 to facilitate endwise insertion of the connector pin assembly 136 into and through the slots 146, 148 of the adapter 34 and wall 18, respectively, of the bucket or implement 10.

As shown, the lower or distal end portion 186 of connector piece 162 is articulately or pivotally connected to the lower or distal end portion 180 of connector piece 160 as by a pivot pin 188 such that the connector piece 162 is pivotally movable about the axis of pin 188 and away from the connector piece 160. Preferably, the pivot pin 188 is formed from plastic or the like material which allows the pin 188 to shear when adequate forces are applied thereagainst it. In the illustrated embodiment, opposite ends of the pivot pin 188 are received and maintained in place by the lower ends of arms 174 and 176 of connector piece 160. Moreover, vertically spaced shear pins 190 and 192 are disposed between the connector pieces 160, 162 for normally maintaining the connector pieces 160, 162 in operable association relative to each other. Like pivot pin 188, the shear pins 190, 192 are designed to shear or break when an adequate force is applied endwise to the connector piece 162.

For purposes described hereinbelow, a compression spring or other suitable resilient member 194 is disposed in the channel 174 between the connector pieces 160 and 162 for urging connector piece 162 away from connector piece 160. In a most preferred form of the invention, connector piece 160 defines a blind cavity 196 for captively accommodating a lengthwise portion of the spring 192 therewithin.

As shown in FIG. 24, the arms 176 and 178 of connector piece 160 define axially aligned openings or bores 198 and 200, respectively, that pass endwise therethrough. Moreover, the upper end portion or region of connector piece 162 defines an elongated bore 202 that aligns with the bores 198 and 200 when the connector pieces 160, 162 are arranged in operable association relative to each other.

In a most preferred form, the connector pin assembly 136 further includes a retention pull ring 204. The purpose of ring 204 is to hold the connector pieces 160 and 162 in operable relation relative to each other until the connector pin assembly 136 is inserted into and through the slots 146, 148 defined by the adapter 34 and the implement 10, respectively. As shown, ring 204 includes a stub shaft 206 that is sized such that it is removably and endwise insertable through the bore 198 of connector piece 160, through the opening 202 in connector piece 162, and through the other bore 200 in the connector piece 160 thereby maintaining the connector pieces 160 and 162 in operable association relative to each other notwithstanding the force applied by spring 194 to urge the connector pieces 162, 164 away from each other. A pull ring 207 is preferably attached to the stub shaft 206 and is arranged to one side of the connector pin assembly 136 to facilitate manual removal of the shaft 206 from association with the connector pin assembly 136. After the connector pin assembly 136 has been inserted into and through the slots 146, 148 in the adapter 34 and the implement 10, respectively, the ring 204 is completely removed from the connector pin assembly 136 such that the spring 194 tends to thereafter apply a continuous separating force to the connector pieces 160, 162 of the connector pin assembly 136.

In accordance with the present invention, the connector pin assembly 136 further includes an apparatus 250 for providing a signal or indication in the event that the connector pin assembly 136 fails to maintain the digging hardware 24 in operable association and in predetermined relation relative to the digging implement 10. The signal apparatus 250 of the present invention comprises an actuatable indicator 252 and an actuator 254 arranged in operable combination with each other and which are preferably carried as part of the connector pin assembly 136. In the form of the invention illustrated in FIGS. 22 and 24, the actuatable indicator 252 includes a signal generator such as a smoke canister 258 that is capable of producing a visual image of smoke when activated. The smoke canister 258 may be substantially the same as that described above with respect to smoke canister 58. Suffice it to say, and as is conventional, the smoke canister 258 has a lanyard 260 operably associated in combination therewith and extending therefrom. The lanyard 260 serves as the actuator 254 for the signal indicator 252 which, in this instance, comprises the smoke canister 258.

As will be appreciated, the purpose of the lanyard 260 is to monitor the predetermined relationship between the connector pieces 160, 162 of the connector pin assembly 136. Upon an inadvertent change in the predetermined relationship between the connector pieces 160, 162 of the connector pin assembly 136, the lanyard 260 actuates the indicator 252 to produce a signal indicative of such change. In the illustrated embodiment, inadvertent displacement of the connector pieces 160, 162, which is indicative of a failure of the connector pin 136, is sensed by and results in displacement of the lanyard 260. As will be appreciated, displacement of the lanyard 260 caused by movement of the connector pieces 160, 162 relative to each other will likewise cause displacement of the lanyard 260 relative to the smoke canister 258 thus resulting in a readily identifiable visual signal of smoke being released by the smoke canister 258.

In the embodiment of the invention illustrated in FIGS. 22 and 24, the smoke canister 258 is releasably mounted within a blind cavity 262 extending lengthwise of and defined by connector piece 160 preferably adjacent to the elongated channel 174. Notably, an access opening 264 located in the channel 174 permits the actuatable indicator 252 of the signaling apparatus 250 to be inserted into the blind cavity 262. A web or vertical wall 266 separates the major length of the cavity 262 from the channel 174. As shown, an aperture or hole 270 passing endwise through the wall 266 is disposed in vertically spaced relation from the opening 264. The hole or opening 270 permits the free end of the lanyard 260 to pass outwardly from the blind cavity 262. Notably, the opening 270 is preferably sized such that it approximates the cross-sectional configuration of the lanyard 260 passing therethrough. As shown, in FIG. 22, as long as the connector piece 162 is arranged in operable combination with the connector piece 160 of the connector pin assembly 136, the opening 264 to the blind cavity 262 is closed and the actuatable indicator 252 of the signaling apparatus or warning indicator is prevented from inadvertently escaping or becoming removed from the cavity 262.

After the actuatable indicator 252, which in this instance comprises the smoke canister 258, is inserted through opening 264 and into the cavity 262, the free end of lanyard 260 is threaded through the opening 270 and is suitably fastened to the connector piece 162 of the connector pin assembly 136. Preferably, a headed fastener 272 (FIG. 25) is used to facilitate attachment of the free end of the lanyard 260 to the connector piece 162 of the connector pin assembly 136. As discussed above, lanyard 260 serves as the actuator 254 for the actuatable indicator 252. As will be understood, the purpose of the lanyard 260 is to monitor the relationship between the connector pieces 160, 162 of the connector pin assembly 136.

Figure 25:
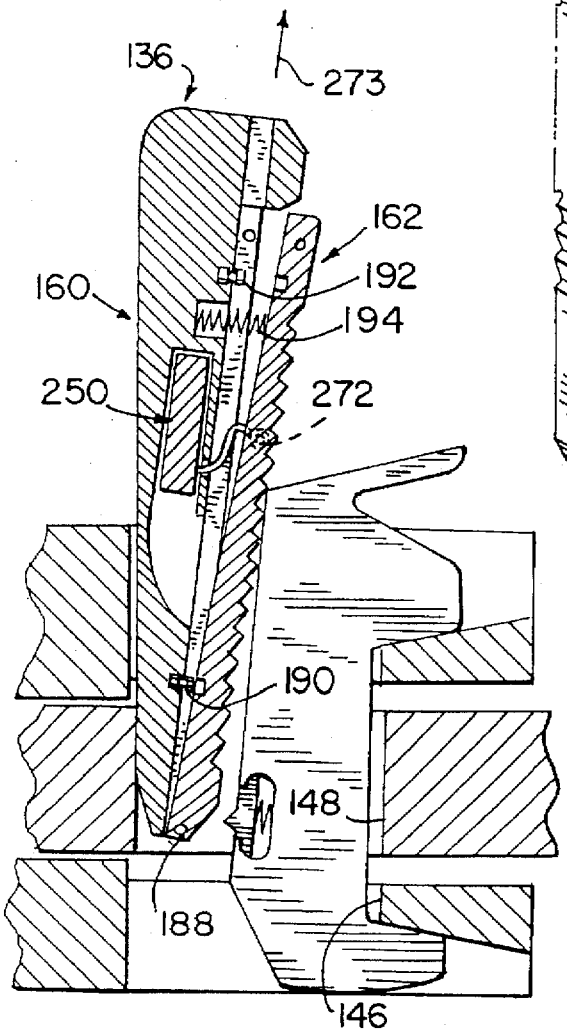
FIG. 25 is a view similar to FIG. 23 but showing the connector pin in the event of a failure of the connector pin.

As mentioned above, the digging or excavating implement 10 is adapted to operate in severe conditions where extreme loads are placed upon the digging hardware and the connector pin assembly 136 adapted to maintain the digging hardware in an operable and predetermined relationship relative to the implement 10. During digging or excavating operations, and because of the wedge shaped configuration of the outer surfaces thereof, the connector pin assembly 136 has a tendency to vertically raise out of the holes or apertures 146, 148 defined by the adapter 34 and the implement 10, respectively, in the direction of arrow 273 (FIG. 25). If and when the connector pin assembly 136 fails, as by raising vertically outwardly from the slots 146, 148, the ability to hold the respective digging hardware in its predetermined relationship relative to the bucket or excavating implement 10 is effected. Thus, and in the event of failure of the connector pin assembly 136, the digging hardware will imminently separate from the implement 10 and become lost in the rubble and excavated materials associated with the digging operation.

Figure 26:
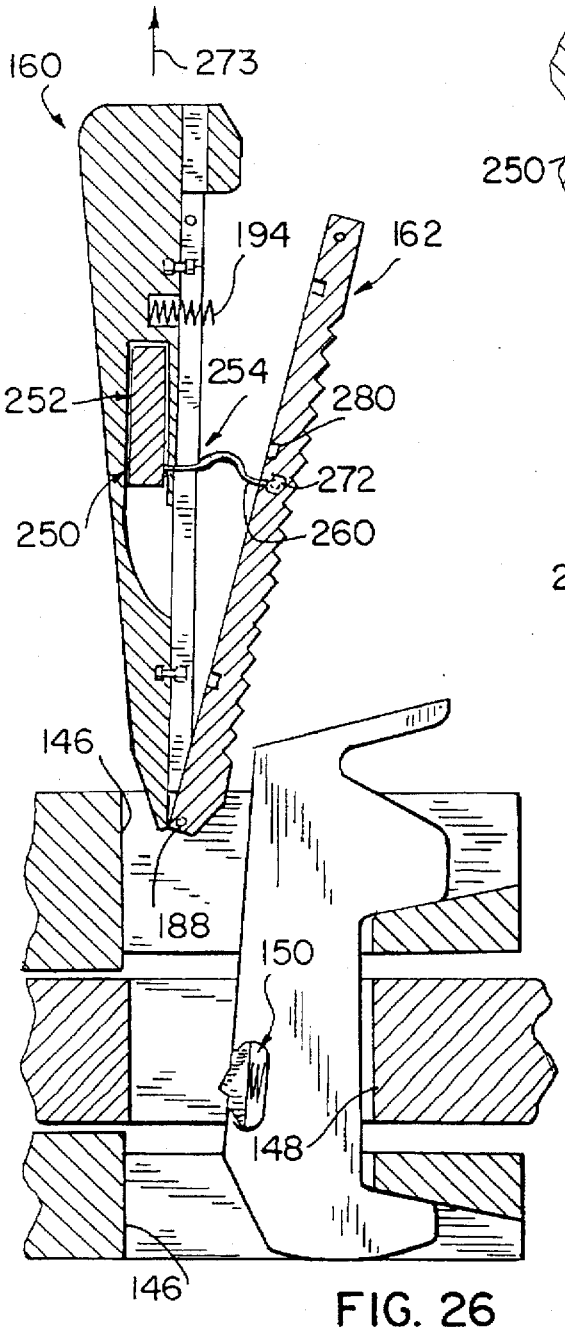
FIG. 26 is a view similar to FIG. 25.

As shown in FIGS. 25 and 26, in the event of failure of the connector pin assembly 136, the connector pieces 160, 162, normally arranged in operable relation relative to each other, are driven apart under the influence of the spring 194. Notably, the shear pins 190, 192 are configured to permit the connector pieces 160, 162 to separate from each other under the influence of the spring 194. The separation of the connector pieces 160, 162 is, to a certain degree, controlled by the pivotal connection 188 established between the pieces 160, 162. As the connector pieces 160, 162 of the connector pin assembly 136 are driven apart from one another, the lanyard 260 tends to move with the connector piece 162 and relative to the actuatable indicator 252. In the illustrated embodiment, movement of the actuator 254 relative to the actuatable indicator 252 causes the smoke canister 258 to activate and release a signal of smoke indicative of the inadvertent change in the predetermined relationship between the connector pieces 160, 162. As will be appreciated, an inadvertent change in the predetermined relationship of the connector pieces 160, 162 likewise indicates the failure of the connector pin assembly 136 to maintain the digging hardware 24 in operable predetermined relation with the digging implement 10. Of course, failure of the connector pin assembly 136 likewise means that loss of the digging hardware connected to the implement by such connector pin assembly is imminent.

Because of the extremely abrasive environment and the extreme loading conditions to which it is subjected, the digging hardware, regardless of its configuration, tends to wear. Moreover, component parts of the digging hardware may break off during normal course of use thus mandating repair/replacement of the digging hardware. It is important to note that according to another aspect of the present invention, the connector pin assembly 136 is configured to allow it to be removed thus facilitating repair/replacement of the digging hardware associated therewith, a suitable without causing without causing the indicating apparatus associated with the connector pin assembly 136 from mistakingly delivering a signal or indication of connector pin assembly failure or the possible loss of digging hardware relative to the implement 10.

Figure 27:
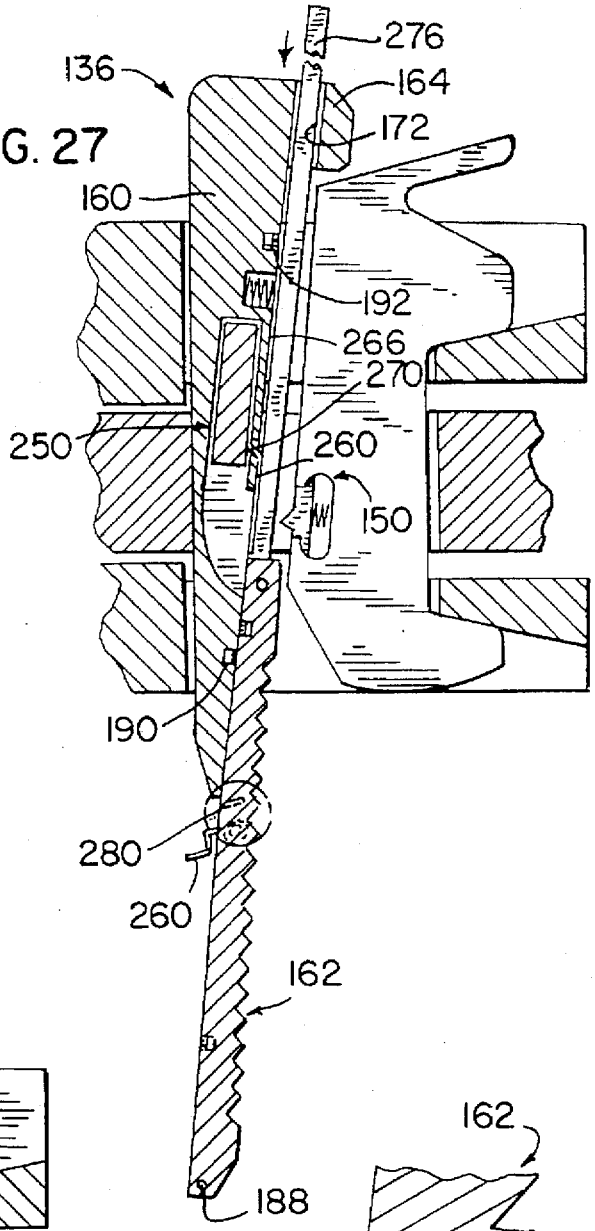
FIG. 27 is a side sectional view showing purposeful disassembly of the connector pin.

As shown in FIG. 27, when the connector pin assembly 136 is to be removed thereby facilitating repair/replacement of the respective digging hardware associated therewith, a suitable shaped tool 276 is inserted through the slot 172 in the head portion 164 of the first connector piece 160 of the connector pin assembly 136 such that an adequate and downwardly directed force can be applied directly to the connector piece 162. The force required to be applied to the tool 276 is equal to the amount of force required to shear the pivot pin 188 and the shear pins 190, 192 that normally hold the first and second connector pieces 160, 162 in endwise operable relation relative to each other. As will be appreciated, after the pivot pin 188 and the shear pins 190, 192 are broken or sheared, the connector piece 162 is permitted to endwise move downwardly relative to connector piece 160. Notably, when the downwardly directed force is applied to the connector piece 162, the resilient bias of the mechanism 150 allows the detent 152 to retract against the action of the spring 154 thereby permitting the serrations 184 on connector piece 162 to move therepast. After the connector piece 162 is separated from the connector pin assembly 136, the connector piece 160 is readily removable thereby allowing the respective digging hardware to be readily replaced/repaired.

Figure 28:
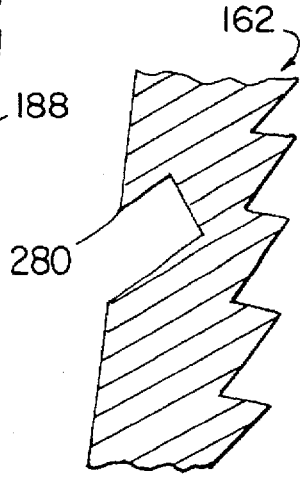
FIG. 28 is an enlarged view of that area encircled in FIG. 27.

As shown in FIGS. 27 and 28, that surface of connector piece 162 that is arranged in abutting relation relative to the web or vertical wall 266 on the connector piece 162 is provided with a cutting edge 280 thereon intermediate opposite ends of the connector piece 162. In a most preferred from of the invention, the edge 280 provided on the connector piece 162 is disposed immediately adjacent and slightly above the aperture or bore 270 through which the lanyard 260 of the indicator apparatus 250 extends when the connector pieces 160, 162 of the connector pin assembly 136 are arranged in their predetermined relationship relative to each other. As will be appreciated, when an adequate and downwardly directed force is applied to the connector piece 162, the edge 280 on the connector piece 162 combines with the periphery of opening 270 to cut or sever the lanyard 260 extending therethrough. Severance of the lanyard 260 prevents inadvertent actuation of the actuatable indicator 252, which in this instance includes the smoke canister 258, while allowing for removal of the connector pin assembly 136 from its operative association with the digging hardware and implement.

As will be appreciated from the above, the indicating or signaling apparatus of the present invention provides a myriad of different methods and/or systems for alerting the operator to the loss or impending loss of digging hardware from the digging or excavating implement. For example, and in one form of the invention, the warning apparatus of the present invention provides an indication to the operator of the implement when there is an inadvertent change in the predetermined relationship of any component of digging hardware relative to the digging implement scoop or bucket 10.

The actuatable indicator operably associated with the warning or indicating apparatus of the present invention can take many different forms and shapes. Rather than using a smoke signal to produce a visual signal indicative of various types of problems with the digging hardware or the mechanism for holding the digging hardware to the implement, it is also well within the spirit and scope of the invention that the actuatable indicator or signal generator for the warning apparatus develop an audio signal indicative of a problem requiring mediate operator attention. It is also well within the spirit and scope of the invention that the signal generator or actuatable indicator of the warning apparatus produce a radio signal to alert the operator to a problem with either the digging hardware or the mechanism for holding the digging hardware in its predetermined relationship relative to the implement.

It is furthermore within the spirit and scope of the present invention that the signal generator or actuatable indicator associated with each component or piece of digging hardware be capable of producing a substantially constant signal that is used in combination with a Global Positioning System (GPS). That is, the constant signals produced by the actuatable indicators of the warning apparatus associated with each piece of digging hardware is directed to a GPS system and then compared on a conventional display (not shown) in the cab region of the digging implement to provide a visual indication of the relative relationship of all the pieces of digging hardware on the front or leading edge 22 of the bucket or excavating implement 10. In this form of the invention, the display would readily and quickly show if a component or piece of digging hardware became disconnected and thus displaced out of order relative to other digging hardware components. Moreover, the use of the present invention in combination with GPS could facilitate location of the lost or misplaced digging hardware and thereby reduce the downtime normally associated with finding or locating the lost hardware.

Alternatively, the warning apparatus or signaling apparatus of the present invention is embodied in combination with a connector pin assembly that serves to operably interconnect the digging hardware in predetermined relation relative to the digging implement. In the event that the connector pin assembly fails, the indicating apparatus of the present invention provides a suitable signal indicative of the failure of the connector pin assembly. As will be appreciated, failure of the connector pin assembly as indicated by the signal provided by the present invention is indicative of imminent or possible loss of the respective digging hardware associated with the connector pin assembly.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A digging tooth assembly for an earth digging implement, said digging tooth assembly comprising:

adapter configured to extend forwardly from a forward edge of said digging implement;

a digging tooth configured to slidably fit about and along a lengthwise portion of and be releasably secured to said adapter, said digging tooth having a ground penetrating edge transversely extending across a forward end portion thereof;

a wear member extending across a rear portion of said digging tooth for protecting said adapter against wear during use of said digging tooth assembly, said digging tooth and said wear member including cooperative instrumentalities for maintaining said digging tooth and said wear member in predetermined relation relative to each other; and an apparatus for providing a signal indicative of an inadvertent change in the predetermined relationship between said wear member and said digging tooth.

2. The digging tooth assembly according to claim 1 wherein said apparatus provides a visual indication of an inadvertent change in the predetermined relationship between said wear member and said digging tooth.

3. The digging tooth assembly according to claim 1 wherein the cooperative instrumentalities for maintaining the wear member and said digging tooth in said predetermined relationship relative to each other comprises suitably shaped outer configurations on the rear end portion of said digging tooth and an abutting surface of said wear member.

4. The digging tooth assembly according to claim 1 wherein said apparatus for providing a signal comprises an actuatable indicator and an actuator, wherein said actuator monitors the predetermined relationship between said digging tooth and said wear member and actuates said indicator to provide a signal indicative of an inadvertent change in the predetermined relationship between said digging tooth and said wear member.

5. The digging tooth assembly according to claim 4 wherein said actuatable indicator further includes a smoke canister protectively carried by one of said digging tooth and said wear member, with said actuator being connected between said canister and the other of said digging tooth and said wear member.

6. The digging tooth assembly according to claim 1 wherein said wear member is arranged in a predetermined relationship with said adapter as long as said wear member and said digging tooth remain in said predetermined relationship relative to each other.

7. The digging tooth assembly according to claim 6 wherein said apparatus for providing a signal comprises an actuatable indicator and an actuator, wherein said actuator monitors the predetermined relationship between said wear member and said adapter and actuates said indicator to provide a signal indicative of an inadvertent change in the predetermined relationship between said adapter and said wear member.

8. The digging tooth assembly according to claim 7 wherein said actuatable indicator further includes a smoke canister protectively carried by one of said adapter and said wear member, with said actuator being connected between said canister and the other of said adapter and said wear member.

9. The digging tooth assembly according to claim 6 wherein said apparatus for providing a signal comprises an actuatable indicator and an actuator, wherein said actuator monitors the predetermined relationship between said digging tooth and said adapter and actuates said indicator to provide a signal indicative of an inadvertent change in the predetermined relationship between said adapter and said digging tooth.

10. The digging tooth assembly according to claim 9 wherein said actuatable indicator further includes a smoke canister protectively carried by one of said adapter and said digging tooth, with said actuator being connected between said canister and the other of said adapter and said digging tooth.

11. The digging tooth assembly according to claim 1 wherein a connector comprised of first and second elongated connector pieces maintains the releasably secured relationship between said digging tooth and said digging implement as long as said connector pieces are arranged in operable combination relative to each other.

12. The digging tooth according to claim 1 wherein a connector releasably connects said adapter to said earth digging implement, and wherein said connector is comprised of first and second elongated connector pieces for maintaining the releasable connection between said adapter and said earth digging implement as long as said connector pieces are arranged in operable combination relative to each other.

13. A digging tooth assembly for a digging implement, said digging tooth assembly comprising:

an elongated high strength digging tooth adapted for rigid connection to and in predetermined relationship with a leading edge of the digging implement;

an actuatable warning apparatus for providing an actuated signal to alert an operator of loss or impending loss of said digging tooth relative to said digging implement.

14. The digging tooth assembly according to claim 13 wherein said warning apparatus provides a visual signal indicative of an inadvertent change in the predetermined relationship between said digging tooth and said digging implement.

15. The digging tooth assembly according to claim 13 wherein said warning apparatus comprises a actuatable indicator and an actuator, wherein said actuator monitors the predetermined relationship between said digging tooth and said digging implement and actuates said indicator to provide the signal indicative of an inadvertent change in the predetermined relationship between said digging tooth and said implement.

16. The digging tooth assembly according to claim 15 wherein said actuatable indicator comprises a smoke canister carried by one of said digging tooth and said implement, with said actuator being connected between said canister and the other of said digging tooth and said implement.

17. The digging tooth assembly according to claim 16 wherein said digging tooth comprises an elongated member having a cutting edge extending across a forward end region of the tooth generally transverse relative to an elongated axis of said member, and a blind socket opening to a rear end portion of the tooth.

18. The digging tooth assembly according to claim 17 wherein said elongated member defines a cavity accessible from the blind socket, and wherein said smoke canister is protectively accommodated within said cavity defined by said elongated cast member of said tooth.

19. The digging tooth assembly according to claim 13 further including an adapter configured with a nose region at a distal end thereof and having a rear end portion configured to allow said adapter to be connected in predetermined relation relative to said digging implement, and wherein said digging tooth is adapted to be arranged in predetermined relationship along and about the nose region of said adapter.

20. The digging tooth assembly according to claim 19 wherein said warning apparatus comprises a smoke canister, protectively carried by one of said digging tooth and said adapter, and an actuator extending from said canister and operably coupled to the other of said digging tooth and said adapter, wherein said actuator monitors the predetermined relationship between said digging tooth and said adapter and activates said canister to release a smoke signal when there is an inadvertent change in the predetermined relationship between the digging tooth and said adapter.

21. The digging tooth assembly according to claim 19 wherein said warning apparatus comprises a smoke canister protectively carried toward a rear end portion of said adapter, and an actuator extending from said canister and having a free end adapted for connection to the digging implement, wherein said actuator monitors the predetermined relationship between said digging implement and said adapter and activates said canister to release a smoke signal when there is an inadvertent change in the predetermined relationship between the digging implement and said adapter.

22. The digging tooth assembly according to claim 13 further including a connector for releasably connecting said digging tooth to said digging implement.

23. The digging tooth assembly according to claim 22 wherein said warning apparatus is carried by said connector.

24. The digging tooth assembly according to claim 22 wherein said connector comprises two elongated connector pieces for maintaining a releasable connection between said digging tooth and said digging implement as long as said connector pieces are arranged in operable combination relative to each other.

25. The digging tooth assembly according to claim 22 wherein a first connector piece of said connector defines a cavity for releasably and protectively accommodating a smoke canister forming part of said warning apparatus, said warning apparatus further including an actuator extending from said canister and operably coupled to a second connector piece of said connector, said first and second connector pieces being arranged in operable combination relative to each other to maintain said digging tooth in releasable association with the digging implement, and wherein said actuator monitors the operable relationship between said connector pieces and activates said smoke canister to release a smoke signal when there is an inadvertent change in the operable relationship of the connector pieces of said connector.

26. The digging tooth assembly according to claim 13 further including an adapter adapted to be arranged in a predetermined relationship with and extend forwardly from a leading edge of said digging implement, said adapter being configured to have said digging tooth arranged in a predetermined relationship relative thereto.

27. The digging tooth assembly according to claim 26 further including a connector for releasably connecting said digging tooth to said adapter.

28. The digging tooth assembly according to claim 27 wherein said warning apparatus is carried by said connector.

29. The digging tooth assembly according to claim 27 wherein said connector comprises two elongated connector pieces for maintaining a releasable connection between said digging tooth and said adapter as long as said connector pieces are arranged in operable combination relative to each other.

30. The digging tooth assembly according to claim 27 wherein a first connector piece of said connector defines a cavity for releasably and protectively accommodating a smoke canister forming part of said warning apparatus, said warning apparatus further including an actuator extending from said canister and operably coupled to a second connector piece of said connector, said first and second connector pieces being arranged in operable combination relative to each other to maintain said digging tooth in releasable association with the digging implement, and wherein said actuator monitors the operable relationship between said connector pieces and activates said smoke canister to release a smoke signal when there is an inadvertent change in the operable relationship of the connector pieces of said connector.

31. The digging tooth assembly according to claim 26 wherein said warning apparatus comprises an actuatable visual indicator and an actuator operably coupled to said visual indicator for monitoring the predetermined relationship between said digging implement and said adapter to provide a visual signal indicative of an inadvertent change in the predetermined relationship between the digging implement and said adapter.

32. The digging tooth assembly according to claim 26 wherein said warning apparatus comprises an actuatable visual indicator and an actuator operably coupled to said visual indicator, wherein said actuator monitors the predetermined relationship of between said digging tooth and said adapter and actuates said visual indicator to provide a visual signal indicative of an inadvertent change in the predetermined relationship between the digging tooth and said adapter.

33. A digging implement having a digging tooth assembly mounted to and in predetermined relationship with a leading edge of said implement, and a warning apparatus including an actuatable indicator and a actuator operably coupled to said indicator, wherein said actuator monitors the predetermined relationship of said tooth assembly and said digging implement and actuates said actuatable indicator to provide a visual signal indicative of an inadvertent change in the predetermined relationship between said digging tooth assembly and said digging implement.

34. The digging implement according to claim 33 wherein said digging tooth assembly comprises a high strength digging tooth arranged in operable combination with an adapter.

35. The digging implement according to claim 34 wherein the actuatable indicator of said warning apparatus comprises a smoke canister protectively carried by one of said digging tooth and said adapter.

36. The digging implement according to claim 33 further including a connector for releasably connecting said digging hardware to the leading edge of the implement.

37. The digging implement according to claim 36 wherein said warning apparatus is carried by said connector.

38. A connector assembly including a connector for releasably maintaining a digging tooth assembly in operable association with a leading edge of a digging implement, said connector further including a warning apparatus operably associated with said connector for providing a signal in the event of a failure of said connector to maintain said digging tooth assembly in operable combination with the leading edge of said implement.

39. The connector assembly according to claim 38 wherein said connector comprises a first and second elongated connector pieces arranged in an operable relationship relative to each other, with outer surfaces on said connector pieces combining to define a wedge shaped outer surface configuration for said connector.

40. The connector assembly according to claim 39 wherein one outer surface configuration of said connector has a serrated surface configuration.

41. The connector assembly according to claim 39 wherein said warning apparatus comprises an actuatable indicator carried by said first elongated connector piece and an actuator operable coupled to said actuator, wherein said actuator monitors the operable relationship between said connector pieces and actuates said actuatable indicator to provide a visual signal indicative of an inadvertent change in the operable relationship of the connector pieces relative to each other.

42. The connector assembly according to claim 41 wherein said actuatable indicator comprises a smoke canister protectively carried by said first connector piece, with said actuator being connected to said second connector piece.

43. The connector assembly according to claim 39 wherein said connector further includes shear pins for inhibiting said connector pieces from endwise movement relative to each other.

44. A connector for maintaining digging hardware in operable association with a digging implement, said connector including two elongated metal pieces configured to pass endwise through the digging hardware in a predetermined relationship relative to each other and an apparatus carried by said connector for indicating possible loss of the operable association between said digging hardware and the digging implement.

45. The connector according to claim 44 wherein said connector further comprises springs for normally urging said metal pieces of said connector away from each other.

46. The connector according to claim 44 wherein said apparatus comprises an actuatable indicator carried by a first elongated metal piece and a free-ended actuator extending from and operably coupled to said indicator, wherein the free end of said actuator is operably coupled to a second elongated piece of said connector such that the actuator monitors the predetermined relationship of said first and second connector pieces and actuates said indicator to provide a visual signal indicative of an inadvertent change in the predetermined relationship of said first and second connector pieces.

47. The connector assembly according to claim 46 wherein said actuatable indicator comprises a smoke canister protectively carried by said first connector piece.

48. The connector assembly according to claim 44 wherein said connector further includes shear pins for inhibiting said connector pieced from endwise movement relative to each other.

49. The connector according to claim 44 wherein the outer surfaces of said connector pieces combine with each other when arranged in their predetermined relationship relative to one another to define a wedge shaped outer surface configuration for said connector.

50. The connector according to claim 49 wherein an outer surface of one of said connector pieces has a serrated configuration disposed between opposite ends of said connector piece.

* * * * *